United States Patent [19]

Collins et al.

[11] Patent Number: 4,680,501

[45] Date of Patent: Jul. 14, 1987

[54] STRENGTHENING MEANS FOR A CRT IN-LINE ELECTRODE COMPONENT

[75] Inventors: Floyd K. Collins, Seneca Falls; George E. Hassler, Auburn, both of N.Y.

[73] Assignee: North American Philips Consumer Electronics Corp., New York, N.Y.

[21] Appl. No.: 405,819

[22] Filed: Aug. 6, 1982

[51] Int. Cl.[4] ..... H01J 29/82

[52] U.S. Cl. ..... 313/456; 313/458

[58] Field of Search ..... 313/409, 411, 414, 417, 313/456, 458, 482

[56] References Cited

U.S. PATENT DOCUMENTS 4,032,811 6/1977 Schwartz et al. ..... 313/417

4,049,990 9/1977 Collins ..... 313/417

*Primary Examiner*—David K. Moore

*Assistant Examiner*—K. Wieder

*Attorney, Agent, or Firm*—John C. Fox

[57] ABSTRACT

The invention relates to improved strengthening means for a substantially planar one-piece electrode component utilized in an in-line multi-beam CRT electron gun assembly. Advantageous ruggedizing properties are achieved by discretely formed longitudinal channels oriented along the sides of the component with defined ledge portions extending outward therefrom; beneficially dimensioned supporting projections are formed as integral extensions thereof. A plurality of cooperating mini-channels are included as transversals in the component to provide a markedly improved structure.

8 Claims, 7 Drawing Figures

STRENGTHENING MEANS FOR A CRT IN-LINE ELECTRODE COMPONENT

TECHNICAL FIELD

This invention relates to a substantially planar one-piece electrode component in a multi-beam in-line cathode ray tube electron gun assembly, and more particularly to improved strengthening means incorporated into the structure of a substantially planar electrode member.

BACKGROUND OF THE INVENTION

Cathode ray tubes (CRT's) commonly used in color television and related display applications conventionally utilize unitized electron gun assemblies which direct a plurality of controlled electron beams to the display screen of the tube. In certain gun assembly constructions, the first and second grid electrode components, such being normally control and screen grid electrodes, are often formed as substantially planar members oriented in substantially parallel planes in spaced apart superposed relationship. In multi-beam guns each of these first and/or second planar electrodes contains several spatially related apertures to accommodate the respective electron beams generated within the assembly. It is very important that these several apertures be accurately and consistently spaced relative to the related apertures in the adjacent electrode components, and, in the case of the first electrode component, with the respective cathode surfaces from which the specific electron beams emanate. These and associated electrodes are conventionally affixed to at least two longitudinal insulative support members of the integrated gun assembly by supporting projections extending from the respective electrode components.

Fabrication of the gun assembly involves embedment of the supporting projections of the related electrode components into the temporarily heat-softened longitudinal insulative support members. In this operation, which is commonly referred to as "beading", the softened support members on opposed sides of the assembly are pressured inward toward the several electrode components thereby forcing the supporting projections thereof into the support members. The opposing compressive pressures tend to exert a distorting force upon the electrode components, this being especially critical to the planar components wherein a bowing or arcuate bending effect sometimes results. Such bowing, however slight, changes the aperture locations relative to those in the adjacent electrode components, thereby producing deleterious inter-electrode spacing relationships within the gun structure. These uncontrollable changes in the related aperture spacings are particularly troublesome in in-line gun constructions wherein the first and the second grid electrodes usually have related apertures of small diameter and close spacings.

Two serious manufacturing control problems are caused by the bowing or warping of the first (G1) and/or second (G2) electrode components. The first of these is variation of cutoff and associated cutoff ratio. Cutoff is defined as the positive cathode (K) voltage at which the electrons cease to flow through the G1 aperture. Cutoff ratio is the ratio of the highest cutoff voltage to the lowest cutoff voltage of the three guns in a given tube. Cathode cutoff ratio is now commonly specified at 1.25, a condition which requires precise G1, G2, and K-G1 spacing control. This has proven to be one of the more difficult manufacturing control problems.

The second control problem relating to bowed G1 and G2 electrodes is variation of focus quality. This is largely determined by gun design, but for the gun construction to be successful, three factors are essential: (a) high quality parts must be used, (b) parts alignment must be accurately maintained, and (c) K-G1 and G1-G2 spacings must be precisely controlled at or near design center for optimum focus performance. This factor is directly related to bow-free electrodes. The most difficult production control parameter is the endeavor to achieve consistent K-G1 spacings for the three associated beams.

There are disclosures in the prior art to ruggedize in-line planar type electrodes by incorporating strengthening ribs such as those taught by Floyd K. Collins in U.S. Pat. Nos. 4,049,990 and 4,049,991.

A second grid electrode having channels therein is also shown in the gun structure disclosed by Allen P. Blacker and James W. Schwartz in U.S. Pat. No. 4,058,753.

While teachings of incorporating strengthening ribs fulfilled the existing needs at the time of disclosure, the state of the CRT art has advanced to stages of greater constructional sophistication wherein gun assemblies are made smaller and more compact, and tube operating requirements more stringent and exacting. In view thereof, improved strengthening of planar type electrodes, to prevent bowing during tube fabrication, is essential to achieving the desired tube performance characteristics required in the present state of the art.

DISCLOSURE OF THE INVENTION

It is therefore an object of the invention to provide a substantially planar CRT in-line electrode component having improved ruggedizing structural means incorporated therein to counteract the distorting forces encountered during the electron gun assembly fabrication procedure.

Another object of the invention is to provide an improved in-line ruggedized electrode component that is formed in a manner to optimize the maintenance of initial shaping when incorporated in a plural beam gun assembly thereby providing the desired subsequent inter-electrode spacings within the gun structure.

These and other objects and advantages are achieved in one aspect of the invention wherein improved strengthening means are provided for a substantially planar one-piece electrode component in a plural electrode in-line multiple beam CRT gun assembly integrated by a plurality of longitudinal insulative support members. The substantially planar component evidences alpha and beta surfaces wherein there are opposed side and end regions having L—L′ and W—W′ axes thereacross. The component contains a center and two side-related spatially positioned apertures located in an in-line relationship substantially coinciding with the L—L′ axis. The center aperture is positioned at the intersection of the L and W axes, while the side-related apertures are located equidistantly therefrom along the L—L′ axis on either side of the W—W′ axis.

The invention relates to electrode component strengthening means in the form of at least one longitudinal channel located in each of the side regions thereof in parallel relationship with the L—L′ axis. Each of these channels is indented inward from the beta surface to extend the full length of the respective side region to form a longitudinal rib projecting from the alpha surface. Extending outward from each channel, for the full length thereof, in the plane of the side region, is a defined ledge having a leading edge substantially parallel with the L—L′ axis. Additionally, at least a pair of spatially-related supporting projections are extended outward equally from either side of the component as integral planar extensions of the respective ledge formations. The facing edges of each pair of projections are beneficially spaced from the W—W′ axis by dimensions in the order of substantially half the separation distance between apertures.

Each of the ruggedizing longitudinal channels is further defined as an open-ended trough formation having width and depth dimensions formed by three adjoining longitudinal surfaces comprising an outer wall, an inner wall and a substantially planar bottom therebetween. As such, each channel evidences two separated longitudinal and parallel strengthening bends therein, the distance therebetween defining the bottom width dimension of the channel.

Each channel evidences a substantially uniform width dimension being in the order of at least twice the thickness of the component material. In like manner, a substantially uniform depth dimension is also evidenced, such being at least substantially equal to the thickness of the component material. Each of the channel-related ledges, which extends in a substantially right-angle relationship with the outer wall of each channel, has an outstanding dimension that is also at least substantially equal to the thickness of the component material.

The electrode component preferably also evidences at least two mini-channels formed as elongated lateral indentations in a surface thereof, preferably the beta surface, being located substantially midway between the center and side-related apertures in parallel relationship with the W—W′ axis thereby transersing the area between the longitudinal side channels. Each of these mini-indentations forms an elongated protrusion from the opposite surface of the component, the height of this protrusion being less than the thickness of the component material.

The electrode component may be further defined as being fabricated in a manner wherein each of the apertures is oriented in an individual spaced-apart dish-like depression formed in the alpha surface in a manner to project as a separate protuberance from the beta surface. In keeping therewith, the aforedescribed mini-channel indentations are located in the spacings between the aperture protuberances.

The aforedescribed strengthening features incorporated in the structural configuration of a substantially planar electrode component effects the beneficial desired ruggedization thereof in a manner not heretofore achieved.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
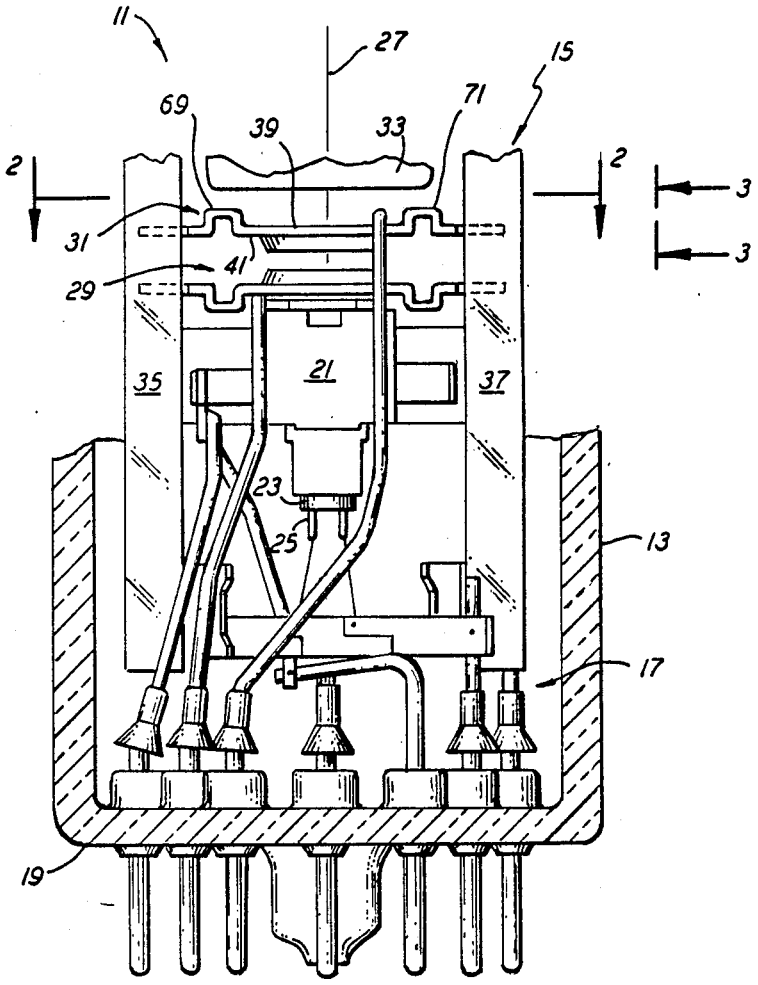
FIG. 1 is a partial elevational view of a section of the neck and closure regions of a CRT showing a portion of the inline electron gun assembly encompassed therein wherein the improved electrode component of the invention is oriented.

With reference to the drawings, there is shown in FIG. 1 a portion of an exemplary plural beam in-line CRT 11 of the type utilized for producing visual displays in television and similar applications. Positioned within the neck portion 13 of the tube 11 is a partially shown multi-element electron gun assembly 15 wherein a plurality of electron beams are formed and individually projected toward the cathodoluminescent display screen formed on the face of the tube, not shown. This plural beam gun assembly 15, which is supported on a circular array of metallic pins 17, traversing the closure portion 19 of the tube, is comprised of an arrangement of sequentially related electrode components.

To provide exemplary detail, reference is again directed to the partial showing of one of the side oriented gun structures of the in-line assembly 15. Starting at the closure end 19 of the tube, the first structural element adjacent thereto is the cathode assembly structure 21. Comprised of an electron emitting cathode 23 with its associated heater element 25, this assembly generates electrons to form the respective beam 27. Sequentially positioned forward from the cathode is a first or control grid electrode component 29 which forms or modulates the electrons into the shaped beam 27, whereupon it is initially accelerated by the influences of the adjacent second or screen grid electrode component 31. The partially shown third grid-electrode component 33 provides focusing, and a fourth or high voltage terminal grid electrode component, not shown, imparts final velocity or acceleration to the respective beam. The several electrode components comprising the plural beam assembly are affixed to and supported by a plurality of at least two longitudinal insulative support members, such as 35 and 37, which are sometimes referred to in the art as multiforms, and are conventionally formed of a glass composition.

As shown in the exemplary gun structure, the adjacent control and screen grid electrode components 29 and 31 are delineated as being substantially similarly formed one-piece substantially planar structures oriented in inverted relationship. It is to this type of planar electrode structure that the present invention is directed. While FIG. 1 shows the utilization of a pair of these electrode components, certain gun constructions may beneficially employ only one such component as either a first or second grid electrode in conjunction with a differently configurated adjacent component. As illustrated, discretely structured channel features are incorporated in the formation of this one-piece substantially planar component to provide markedly improved ruggedizing properties to prevent deleterious warping or bowing of the electrode component during gun assembly fabrication. The importance of maintaining accurate G1, G2, and K-G1 spacings has been previously mentioned herein.

Figure 2:
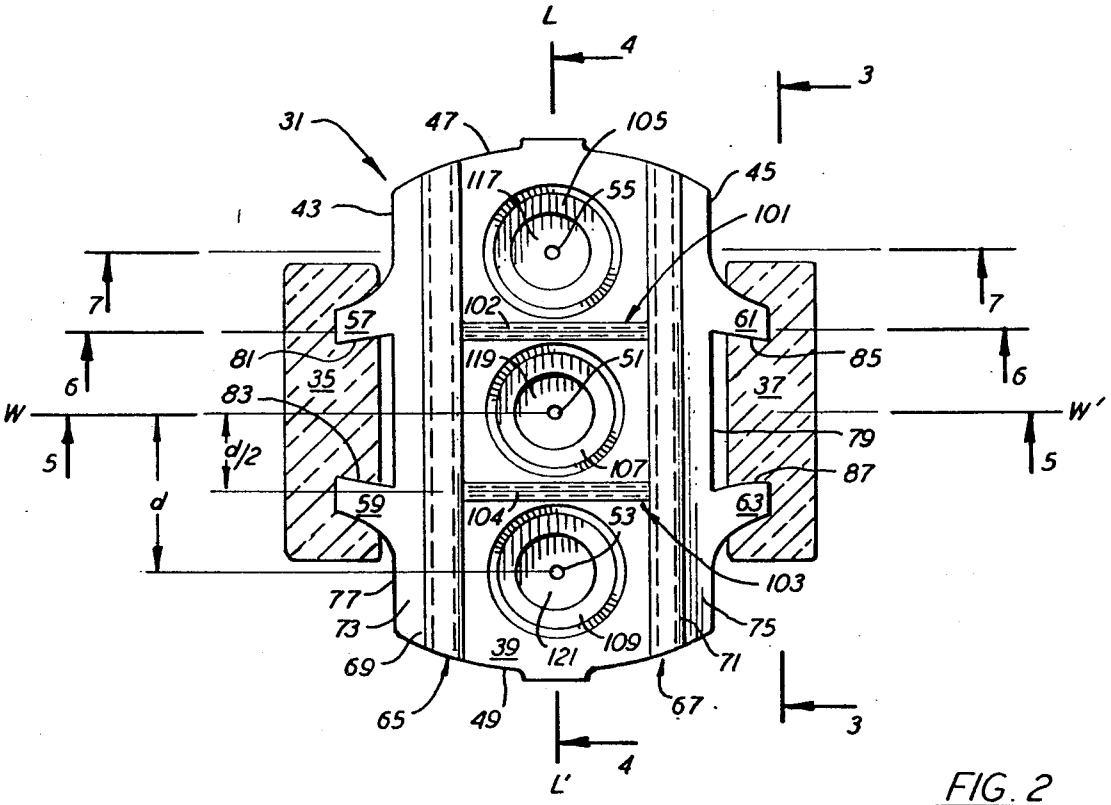
FIG. 2 is a plan view of the improved electrode component of the invention taken along the line 2—2 of FIG. 1.
Figure 3:
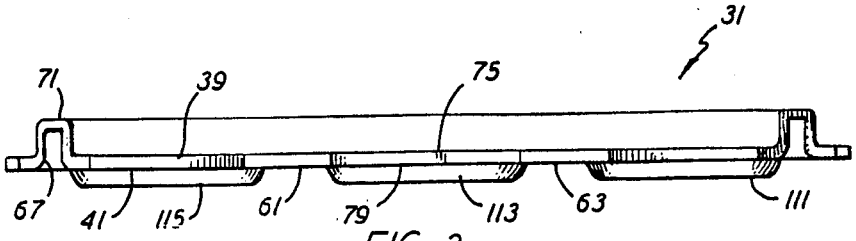
FIG. 3 is a side view of the electrode component taken along the line 3—3 of FIGS. 1 and 2.
Figure 4:
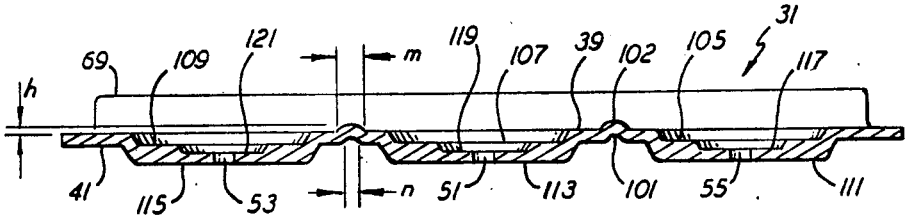
FIG. 4 is a sectional view of the electrode component taken lengthwise along the L—L′ axis or line 4—4 of FIG. 2.
Figure 5:
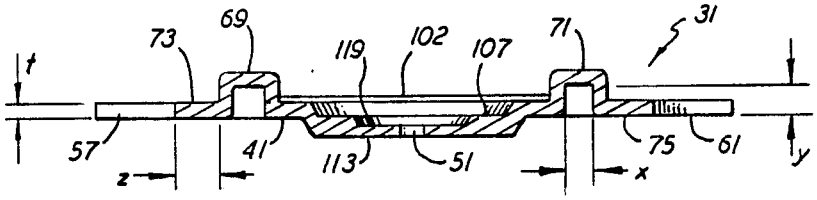
FIG. 5 is a sectional view of the component taken widthwise along the W—W′ axis or line 5—5 of FIG. 2.

In greater detail, reference is directed to FIG. 2 wherein a plan view of the screen grid electrode component 31 is shown, as taken along the line 2—2 of FIG. 1, such being an example of the structure of the invention. This one-piece substantially planar metallic component 31 is formed of non-magnetic material having a thickness (t) such as 15 mils (0.381 mm). The component evidences alpha 39 and beta 41 surfaces, and has distinguishing opposed side regions 43, 45 and opposed end regions 47, 49. Definitive lengthwise L—L′ and widthwise W—W′ axes are provided to aid in description of the component, whereof the cross-sectional configurations are shown in FIGS. 4 and 5 respectively.

The electrode component contains a center aperture 51 and two side-related apertures 53 and 55 which are formed therethrough and located in an in-line relationship substantially coinciding with the L—L′ axis. The center one 51 of these apertures is located at the intersection of the aforementioned L and W axes, while the side related apertures 53 and 55 are oriented equidistantly (d) therefrom along the L—L′ axis on either side of the W—W′ axis.

Additionally, the electrode component has at least a pair of opposed supporting projections 57, 59 and 61, 63 extending from either side thereof in a positional manner for attachment to the respective insulative assembly support members 35 and 37. This affixture is accomplished by the beading procedure during electron gun assembly fabrication wherein the longitudinal glass support members or multiforms are selectively heated to a softened stage, whereupon they are pressed against the carefully positioned electrode supporting projections to consummate firm embedment of the projections within the support members. It is during this stage of gun assembly fabrication that the merits of the invention are most benefically manifest.

As clearly shown in the drawings, at least one longitudinal channel 65, 67 is located in each of the respective side regions 43 and 45 of the electrode component 31 in parallel relationship with the L—L′ axis. These channels are indented inward from the beta surface 41 of the component for the full length of the respective side regions 43, 45 to form two longitudinal ribs 69, 71 which project from the alpha surface 39.

Each of the channels has a discretely defined ledge 73, 75 which extends outward therefrom in the plane of the respective side region 43, 45 for the full length thereof. The leading edges 77, 79 of the respective ledges are substantially parallel with the L—L′ axis. The aforementioned pairs of spatially-related supporting projections 57, 59 and 61, 63 are fashioned to extend equally from either side of the electrode component 31 as integral planar extensions of each respective ledge formation 73, 75. The facing edges of each pair of projections 81, 83 and 85, 87 are respectively spaced from the W—W′ axis by dimensions in the order of substantially half (d/2) the separation distance (d) between apertures 51 and 53. This facial separation of the elements of each pair of projections has been found to be an important factor in achieving equalized and uniform support for the component.

In considering the longitudinal channels 65, 67 in greater detail, each is distinctly fashioned as an open-ended trough-like structural formation having width (x) and depth (y) dimensions formed by three adjoining substantially rectangular longitudinal surfaces exemplarily defining an outer wall 89, an inner wall 91, and a bottom area 93 therebetween. Each trough-like channel evidences two longitudinal and parallel strengthening bends 95, 97 which form the respective jointure regions between the walls and bottom portions thereof. As such, the parallel separation of the bends defines the bottom width (x) of the channel. It is desired that each bend produces a right angle relationship 96, 98 between the respective wall and bottom portion. Such is achieved with the subject 15 mil material (t) by consummating a bend evidencing an internal radius in the order of 5 mils (0.13 mm). Cross-sectionally, each channel evidences a substantially uniform depth dimension (y) that is at least substantially equal to the thickness ($\geqq$t)of the component material, and a uniform width dimension (x) that is also at least substantially equal to the thickness ($\geqq$t) of the component material. Each of the channel-related ledges 73, 75, which projects in a substantially right-angle relationship from the outer wall of each channel, has an outstanding width dimension therefrom that is at least substantially the thickness ($\geqq$t) of the component material. This ledge width dimension, in conjunction with the substantially 90° angular jointure 99 with the outer sidewall 89 of the channel, additionally augments the longitudinal strengthening of the electrode component In the present instance, this angular jointure 99 is effected by an inner radius in the order of 5 mils (0.13 mm), (t/3).

Figure 6:
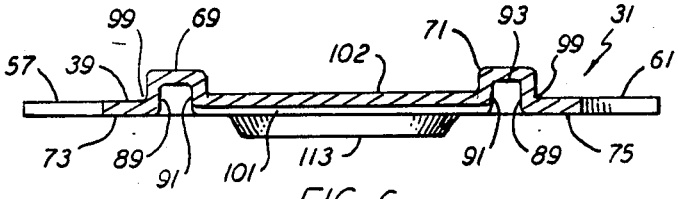
FIG. 6 is a sectional view of the component taken along the line 6—6 of FIG. 2.
Figure 7:
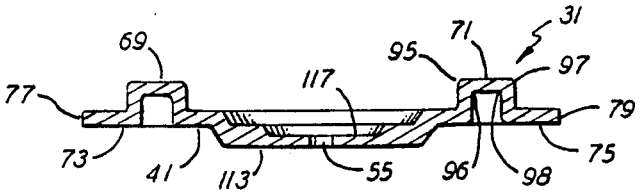
FIG. 7 is a sectional view of the electrode component taken along the line 7—7 of FIG. 2.

Further ruggedization of the electrode component 31 is provided by at least two mini-channels 101, 103 which are formed as elongated lateral indentations in the beta surface 41 of the component. These mini-indentations transverse the area between the side-oriented longitudinal channels 65, 67, and as such are located substantially midway between the apertures (d/2) in parallel relationship with the W—W′ axis. As shown in FIGS. 4, 5, and 6, each of the mini-indentations 101, 103 forms a respective elongated protrusion 102, 104 from the alpha surface 39 of the component. For example, the height (h) above the alpha surface is less than the thickness (<t) of the component material, being in the order of 5 mils (0.13 mm), (t/3). In keeping therewith, the width (m) of the protrusion is in the order of 30 mils (0.76 mm), (2t); while the width (n) of the mini-channel on the beta surface 41 is in the order of 15 mils (0.38 mm), (t).

While not always a mandating constructional feature of the electrode component, the apertures 51, 53, 55 may be oriented in individual spaced-apart dish-like depressions 105, 107, 109 formed in the alpha surface 39 to project as separate aperture protuberances 111, 113, 115 from the beta surface 41. As delineated in the drawings, the bottom apertured areas 117, 119, 121 of the respective dish-like depressions may be coined to a reduced thickness. In accordance with this construction, the mini-channel indentations 101, 103 are located in the spacings between the aperture protuberances.

As evidenced, the channel formations of the invention are discretely located to provide the electrode component with improved ruggedizing properties which effectively counteract the traversely-oriented distorting forces that are encountered during electron gun assembly fabrication and subsequent tube processing. Therefore, the strengthening features of the invention provide an improved substantially planar in-line electrode component that resists warping and bowing, both longitudinally and laterally, thereby maintaining desired dimensional positioning within the gun assembly.

While there has been shown and described what are at present considered the preferred embodiments of the invention, it will be obvious to those skilled in the art that various changes and modifications may be made therein without departing from the invention as defined in the appended claims.

We claim:

1. Improved strengthening means for a substantially planar one-piece electrode component in a plural electrode in-line multi-beam cathode ray tube electron gun assembly integrated by a plurality of longitudinal insulative support members, said electrode component evidencing alpha and beta surfaces and having opposed side and end regions with defining L—L′ and W—W′ axes thereacross; said component having a center and two side-related spatially positioned apertures therethrough located in an in-line relationship substantially coinciding with said L—L′ axis, the center aperture being located at the intersection of said L and W axes, with said side-related apertures oriented equidistantly therefrom along said L—L′ axis on either side of said W—W′ axis; said strengthening means comprising:

at least one longitudinal channel located in each of the side regions of said component in parallel relationship with said L—L′ axis, each of said channels being indented inward from said beta surface of said component for the full length of said region to form a longitudinal rib projecting from said alpha surface, each of said channels being an open-ended trough formation having width and depth dimensions formed by three adjoining longitudinal surfaces defining an outer wall portion, an inner wall portion and a bottom portion therebetween, each of said channels displaced inwardly from either side of said component to form ledges in the beta surface between the channels and the side edges of the component, the ledge edges being substantially parallel with said L—L′ axis and extending along the full length of said side region; each of the channel-related ledges having an outstanding dimension at least substantially equal to the thickness of the component material and supporting projections extending from either side of said component; the supporting projections being integral planar extensions of said ledge formations.

2. An improved electrode component of the in-line CRT electron gun assembly according to claim 1 wherein each of said channels evidences two longitudinal and parallel strengthening bends therein, said bends being separated to define the bottom width dimension of said channel.

3. An improved electrode component of the in-line CRT electron gun assembly according to claim 1 wherein each channel evidences a substantially uniform depth dimension that is at least substantially equal to the thickness of said component material.

4. An improved electrode component of the in-line CRT electron gun assembly according to claim 1 wherein each channel has a substantially uniform width dimension that is at least substantially equal to the thickness of said component material.

5. An improved electrode component of the in-line CRT electron gun assembly according to claim 1 wherein each of said channel-related ledges extends in a substantially right-angle relationship with the outer wall of said channel.

6. An improved electrode component of the in-line CRT electron gun assembly according to claim 1 wherein at least two mini-channels are formed as elongated lateral indentations in the beta surface of said electrode component, said mini-indentations transversing the area between said side longitudinal channels and being located substantially midway between said apertures in parallel relationship with said W—W′ axis.

7. An improved electrode component of the in-line CRT electron gun assembly according to claim 6 wherein each mini-indentation forms an elongated protrusion from the alpha surface of said electrode component, the height of said protrusion being less than the thickness of said component material.

8. An improved electrode component of the in-line CRT electron gun assembly according to claim 6 wherein each of said apertures is oriented in an individual spaced-apart dish-like depression formed in said alpha surface to project as a separate protuberance from said beta surface, and wherein said mini-channel indentations are located in the spacings between said aperture protuberances.

* * * * *